US008491268B2

(12) United States Patent
Chamberlain

(10) Patent No.: US 8,491,268 B2
(45) Date of Patent: Jul. 23, 2013

(54) SAFETY PROPELLER

(76) Inventor: Colin David Chamberlain, Calen (AU)

( * ) Notice: Subject to any disclaimer, the term of this patent is extended or adjusted under 35 U.S.C. 154(b) by 857 days.

(21) Appl. No.: 12/444,101

(22) PCT Filed: Sep. 25, 2007

(86) PCT No.: PCT/AU2007/001448
§ 371 (c)(1),
(2), (4) Date: Jan. 19, 2010

(87) PCT Pub. No.: WO2008/040049
PCT Pub. Date: Apr. 10, 2008

(65) Prior Publication Data
US 2010/0111703 A1 May 6, 2010

(30) Foreign Application Priority Data

Oct. 2, 2006 (AU) ..... 2006905421
Oct. 30, 2006 (AU) ..... 2006233263

(51) Int. Cl.
*B63H 1/18* (2006.01)

(52) U.S. Cl.
USPC ..... 416/228; 416/231 B

(58) Field of Classification Search
USPC ..... 416/228, 231 B
See application file for complete search history.

(56) References Cited

U.S. PATENT DOCUMENTS

| | | | | |
|---|---|---|---|---|
| 2,045,383 | A * | 6/1936 | Faber | 415/222 |
| 2,160,323 | A * | 5/1939 | Barnett | 416/231 R |
| 4,251,189 | A | 2/1981 | Zinsser et al. | |
| 5,165,859 | A | 11/1992 | Monroe | |
| 5,645,403 | A * | 7/1997 | Bogage | 416/235 |
| 6,106,235 | A | 8/2000 | Tettenborn et al. | |
| 6,644,926 | B1 * | 11/2003 | Vandyke | 416/228 |
| 6,705,554 | B1 | 3/2004 | Kolle | |
| 6,994,523 | B2 * | 2/2006 | Eguchi et al. | 416/228 |

FOREIGN PATENT DOCUMENTS

| | | |
|---|---|---|
| GB | 291281 | 5/1928 |
| GB | 400913 | 3/1932 |
| GB | 396716 | 8/1933 |
| GB | 1200162 | 7/1970 |
| GB | 2110307 | 6/1983 |
| JP | 48-033592 | 5/1973 |
| JP | 10-264889 | 10/1998 |

OTHER PUBLICATIONS

PCTAU07001448 ISR, PC, Sep. 25, 2007.
Japanese Patent Appln. No. 2009-530734; Official Action dated Nov. 20, 2012.

* cited by examiner

*Primary Examiner* — Ninh H Nguyen
(74) *Attorney, Agent, or Firm* — Duane Morris LLP

(57) ABSTRACT

A propeller (10,110) has a hub (20,120) with blades (40,140). A safety member (50,150) is provided along at least a portion of the leading edge (43,143) of each blade (40,140); and the blades (140) may incorporate anti-cavitation slots (160).

16 Claims, 6 Drawing Sheets

SAFETY PROPELLER

CROSS-REFERENCE TO RELATED PATENT APPLICATIONS

The present application is a U.S. national stage application under 35 U.S.C. §371 of PCT Application No. PCT/AU2007/001448, filed Sep. 25, 2007, the entirety of which is incorporated herein by reference.

BACKGROUND OF THE INVENTION

THIS INVENTION relates to a safety propeller.

The invention is particularly suitable for, but not limited to, a safety propeller for watercraft.

The term "watercraft" will include boats as small as dinghies or tenders fitted with outboard motors; through pleasure boats and speedboats with inboard/outboard motors; up to large ships such as cargo ships, tankers and military vessels.

PRIOR ART

Rotating watercraft propellers have always been a source of danger for persons (eg., skiers) or animals (eg., dugongs or other sea creatures) which come into contact with them.

Furthermore, in shallow waters, the propeller blades tend to dig into the river-, lake- or seabeds, both damaging the propellers and causing environmental damage to the beds.

One solution to minimise the problem has been the development of so-called "ring propellers" which have a continuous, or interrupted, ring around the distal ends, of the blade to prevent, or minimise, contact between the leading edges of the blades and any obstruction. However, such ring propellers generally have significantly minimised performance when operating in reverse.

SUMMARY OF THE PRESENT INVENTION

It is an object of the present invention to provide a safety propeller, preferably for watercraft, where any damage to any obstruction by the leading edges of the blades of the propeller is minimised.

It is a preferred object of the present invention to provide such a safety propeller where safety members are formed integrally with, or are fitted to, the leading edges of the blades.

It is a further preferred object of the present invention to provide such a propeller where the position of the safety members has little, if any, negative effect on the performance of the propeller when compared to conventional propellers.

It is a still further preferred object to provide such a propeller where minimal, if any, damage occurs to the blades when they strike an obstruction.

It is a still further preferred object to provide such a propeller with anti-cavitation slots in the blades to maximise the performance of the propeller.

Other preferred objects of the present invention will become apparent from the following description.

In one aspect, the present invention resides in:

a safety propeller, preferably for watercraft, of the type having a hub and a plurality of blades, where each blade has a leading edge extending from a proximal end of the blade adjacent the hub to a distal end spaced from the hub; and a respective safety member is provided over at least 50% of the leading edge of each blade, each safety member being of greater thickness and/or height than the leading edge, and at least a portion of the safety member extends from a thrust or driving face of the blade in the forward direction of rotation of the propeller.

NB: For a propeller which rotates in a clockwise direction, (when viewed from the trailing end of the hub), the safety member on each thrust or driving face of the blade appears to be directed towards the trailing end of the propeller.

Preferably, the safety member extends over more than 50% of the length of the leading edge of the blade and is of a greater height so that the safety means will strike any obstruction before the balance of the leading edge not provided with the safety member.

While the safety member may be of a constant height over the leading edge, it may be of relatively increasing height towards the distal end of the blade.

While the safety member may be located with a central axis substantially parallel to, or aligned with, the leading edge, it is preferable that the central axis increasingly leads the leading edge of the blade in the direction from the proximal end to the distal end of the blade.

Preferably, the safety member is smoothly contoured into the adjacent portion of the blade.

The safety member may be mounted on (eg., by welding or brazing), or formed integrally with, the blade.

The relative height of the safety member to the leading edge of the blade; the relative thickness of the safety member to the thickness of the blade; and/or the relative degree by which the central axis of the safety member leads the leading edge of the blade, may be varied to suit the particular intended application for the safety propeller.

Preferably, at least one anti-cavitation slot is provided in each blade.

Each cavitation slot may be of circular, square, rectangular or modified rectangular (ie., a rectangle with semi-circular ends) shape in plan view.

Preferably, the or each side wall of the anti-cavitation slot extends through blade substantially parallel to the rotational axis of the propeller.

In a second aspect, the present invention resides in a propeller, preferably for watercraft, of the type having a hub and a plurality of blades, where each blade has a respective leading edge and trailing edge extending from respective proximal ends of the blade adjacent the hub to a distal end spaced from the hub; wherein:

at least one anti-cavitation slot extends through each blade, spaced from the respective leading edge and trailing edge of the blade.

The or each anti-cavitation slot may be of circular, square, rectangular, modified-rectangular (ie., a rectangle with semi-circular ends) or other shape in plan view.

Preferably, the, or each, side wall of each anti-cavitation slot lies substantially parallel to the rotational axis of the hub.

Preferably, the, or each, anti-cavitation slot is spaced at least 50% of the distance between the leading edge and the trailing edge of the blade, measured at the hub.

Preferably, the, or each, anti-cavitation slot is spaced 20% to 70% of the distance from the hub to the distal end of the blade.

Preferably, for the anti-cavitation slots of square, rectangular and modified shape, the opposed side walls of the anti-cavitation slots extend substantially parallel to a central axis of the slots extending substantially radially from the hub.

In a third aspect, the present invention resides in a safety propeller of the first aspect, which incorporates the anti-cavitation slots of the second aspect.

BRIEF DESCRIPTION OF THE DRAWINGS

To enable the invention to be fully understood, preferred embodiments will now be described with reference to the accompanying drawings, in which.

DETAILED DESCRIPTION OF THE PREFERRED EMBODIMENTS

Figure 1:
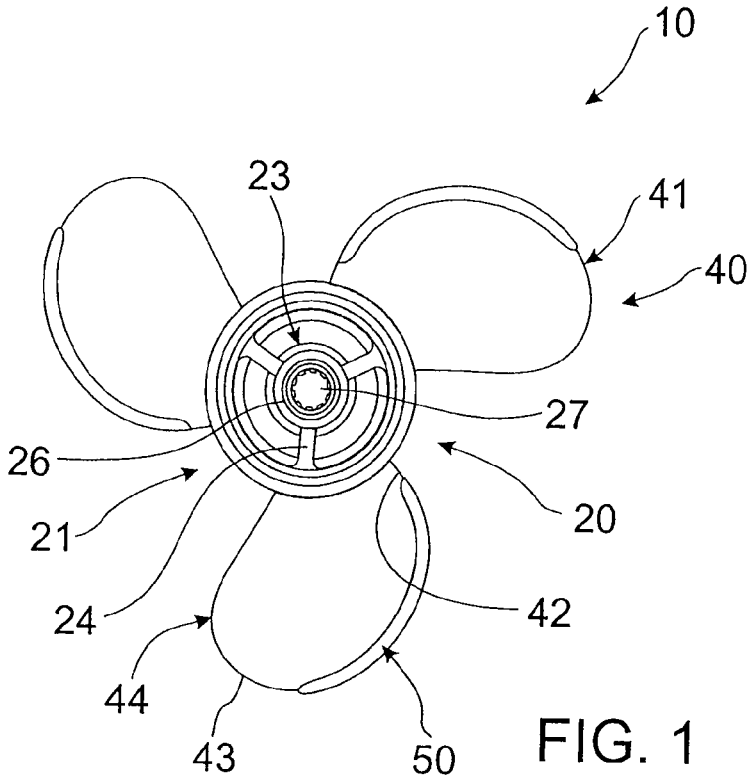
FIGS. 1 and 2 are respective front and rear elevations of a first embodiment of a propeller in accordance with the present invention.
Figure 2:
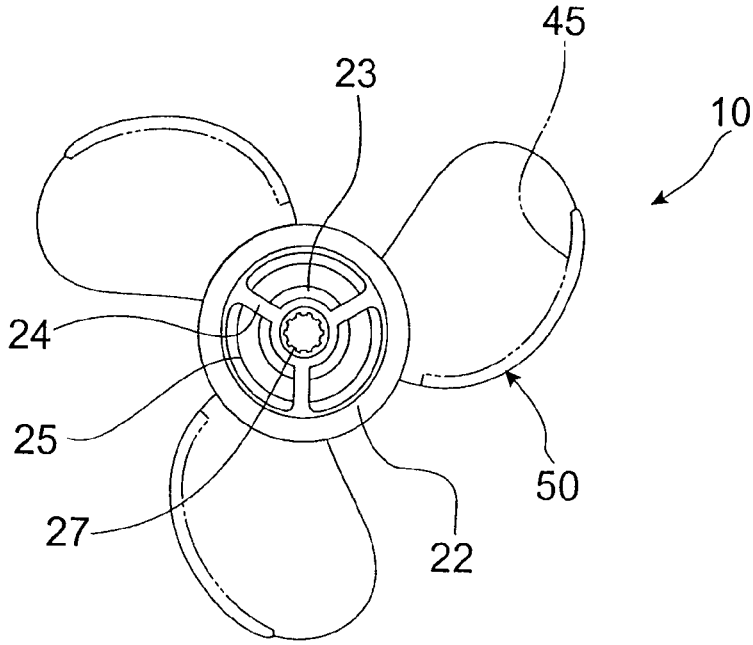
Figure 3:
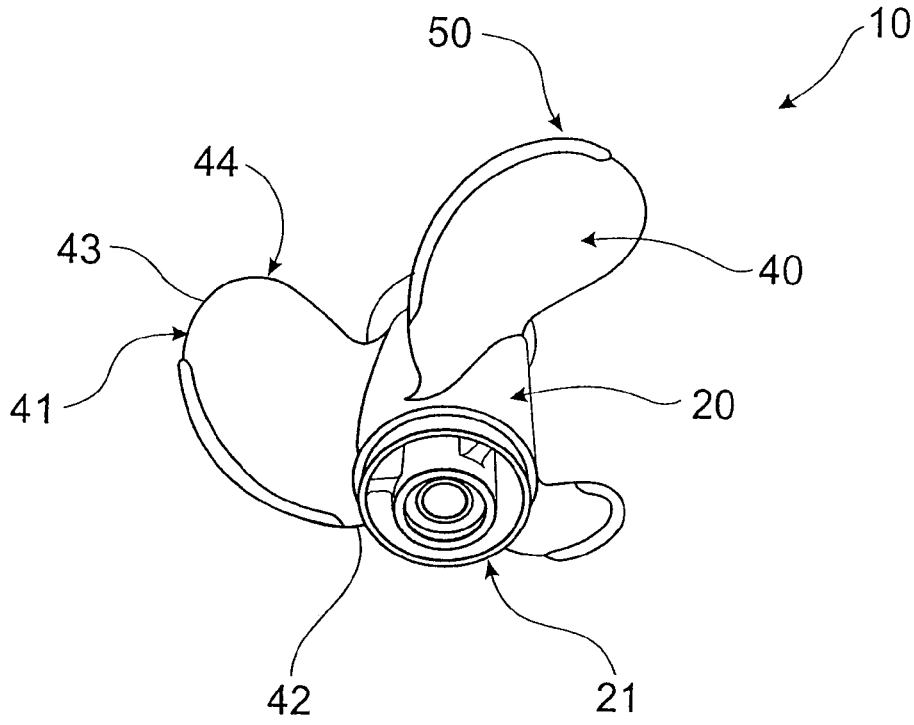
FIGS. 3 and 4 are respective perspective and side elevational views of the first embodiment.
Figure 4:
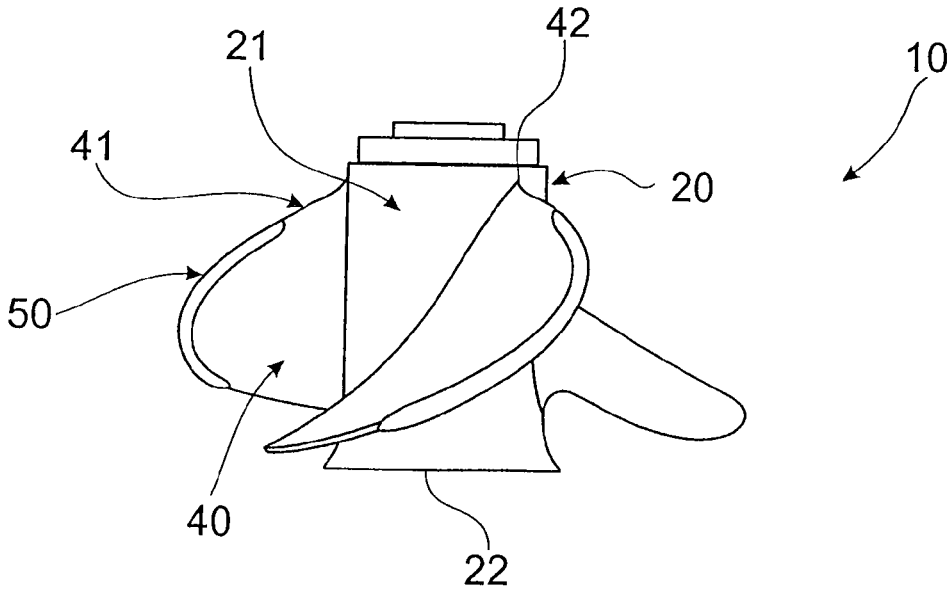
Figure 5:
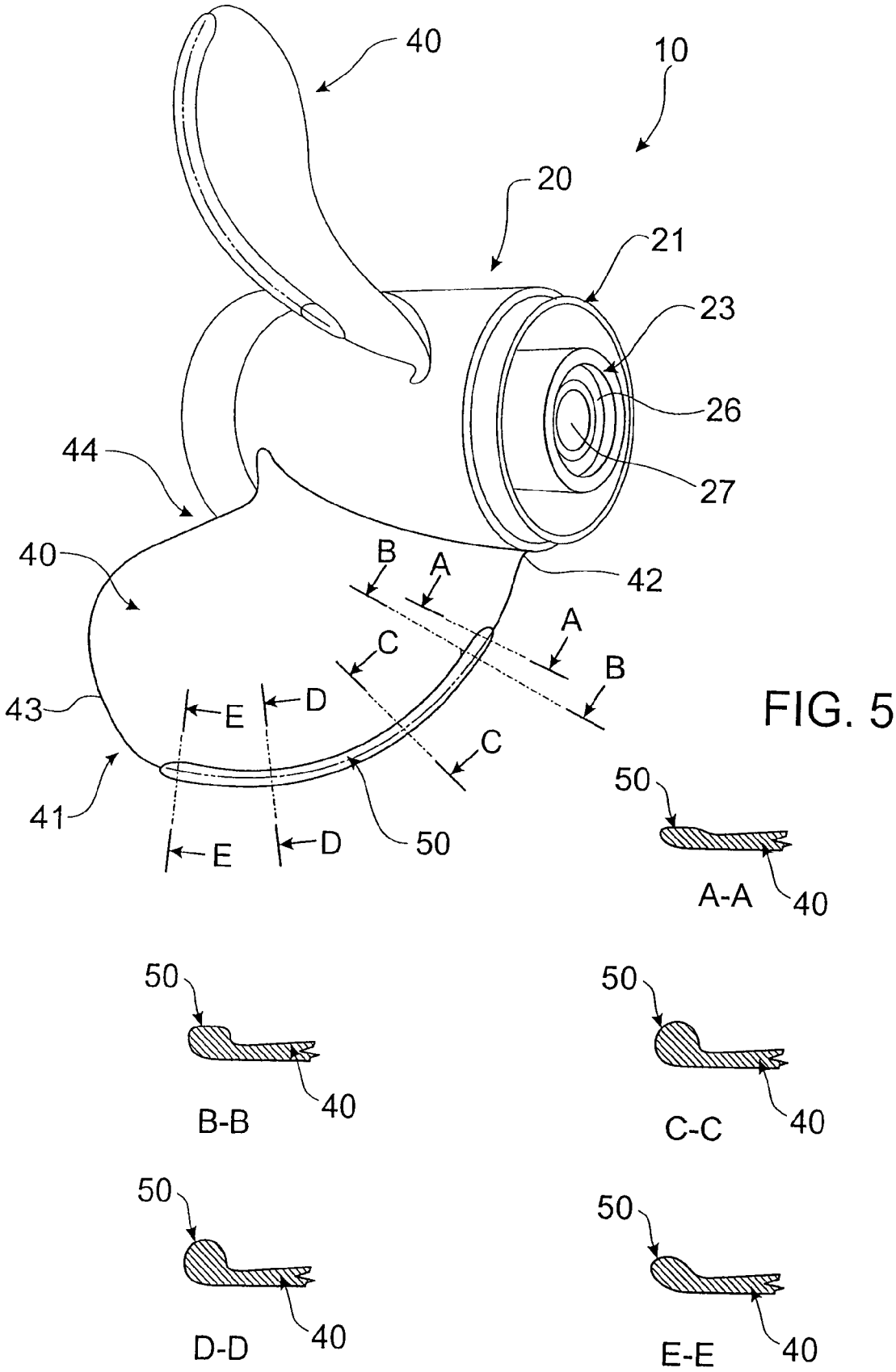
FIG. 5 is a front perspective view of the first embodiment showing the sectional view of one blade on lines A-A to E-E respectively.
Figure 6:
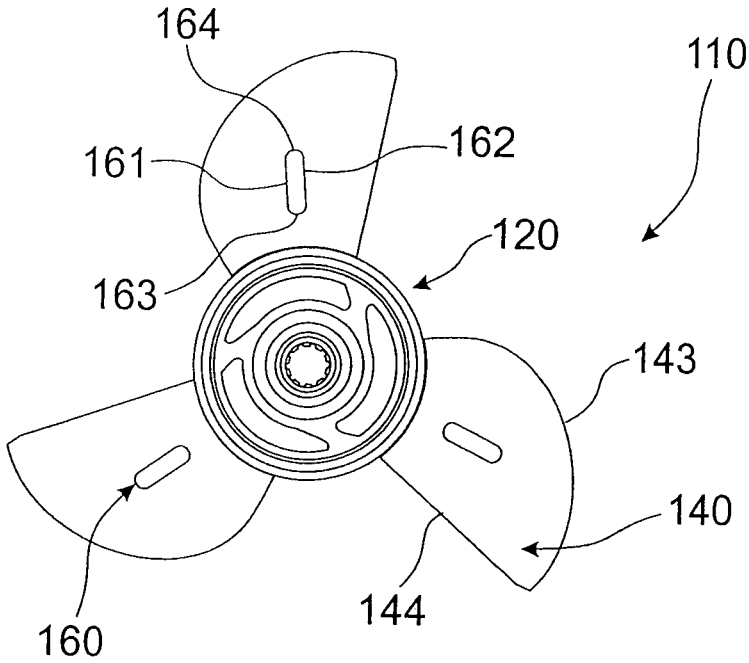
FIG. 6 is a front view of a second embodiment of a propeller in accordance with the present invention.

In the first embodiment illustrated in FIGS. 1 to 5, an "off the shelf" propeller has had each of its 3 blades modified to incorporate the safety members of the present invention.

It will be readily apparent to the skilled addressee that the safety members may be manufactured integrally with the blades; and that the number, size and shape of the blades on the propeller will be dependent on the intended application(s) for the particular safety propeller made in accordance with the present invention.

In the specific embodiment illustrated, the propeller 10 has a hub 20 with three (3) equally spaced blades 40, to be hereinafter described in more detail.

The hub 20 has an outer tubular body 21 which is outwardly flared to a trailing end 22.

An inner tubular body 23 is connected to the outer tubular body 21 by three (3) spaced ribs 24; where the outer body 21, the inner body 23 and the ribs 24 define three (3) exhaust passages 25 through the hub 20.

The inner body 23 has a tubular vibration damping body 26, which supports a splined tubular driving body 27 mountable on the output shaft (not shown) of a suitable power source (eg., an outboard motor/inboard/outboard drive or the drive shaft or propeller shaft of an inboard motor).

Each blade 40 has a curved leading edge 41 with a proximal end 42 adjacent the hub 20 and a distal end 43 at the periphery of the blade 40, where the distal end 43 leads into the trailing edge 44 of the blade.

A recess 45 is machined into the leading edge 41 of the blade over approximately 70-80% of the length of the leading edge. In the specific example to be hereinafter described, the depth of the recess 45 is approximately 4-5 mm, where the safety member 50 to be hereinafter described is formed of a rod or cylinder of 6 mm diameter.

It will be apparent to the skilled addressee that the depth of the recess 45 may be as shallow as, eg., 1 mm, so that the relative height of the safety member 50 relative to the leading edge 41 of the blade 40 may be varied to suit the particular intended application when the safety member 50 is made of material of a particular thickness or diameter.

The safety member 50 in the present example is formed from a length of 6 mm diameter aluminium rod which is placed in the recess 45, and where the central axis of the safety member 50 is progressively advanced forwardly of the leading edge 41 of the blade 40 in the direction from the proximal end 42 to the distal end 43. (As hereinbefore described, in side view, the safety member 50 extends to the rear of the thrust or driving face of the blade 40, ie., towards the trailing end 22 of the hub 20.)

For a counter-rotating propeller, the propeller will be a "mirror-image" of the propeller illustrated.

While it is preferable that the central axis of the safety member 50 progressively extends from the leading edge 41 of the blade 40 in the direction from the proximal end 42 to the distal end 43, this is not essential to the invention, and the central axis may be parallel with, or aligned with, the leading edge 41 of the blade.

In experiments conducted with the propeller of the first embodiment illustrated in FIGS. 1 to 5 of the drawings, there has been no loss of performance in the forward direction compared with the propeller before modification (and indeed, there has been a minimal increase in speed). Furthermore, there has been little, if any, loss in efficiency in the modified propeller when operating in the reverse direction.

Preferably, the profile of the safety member 50 is "blended" or "contoured" into the profile of the blade 40 adjacent to the safety member 50.

While the safety member 50 in this embodiment has been manufactured from solid rod, it could be manufactured from, eg., timber or U-section material.

It will be readily apparent to the skilled addressee that the safety member 50 may be formed integrally with each blade at the time of manufacture.

The safety member 50 may be manufactured from the same material as the propeller, such as metal (eg., aluminium), plastics (which may be fibre-reinforced) "Kevlar" (trade mark), carbon fibre, or other suitable materials; or may be made from such materials selected, eg., for their impact strength.

In experiments conducted in very shallow water, it has been found that the blades 40 do not cut into the underlying waterbed, but that the propeller 10 tends to "walk" over the bed until deeper water is reached. Furthermore, little, if any, damage to the blades 40 (or the safety member 50) was noted, minimising imbalances in the propeller 10 or potential sites for blade failure.

While the safety member 50 can be provided over the full length of the leading edge of each blade 40, it is preferable that the safety member 50 extends along such a portion of the leading edge 41 so that the safety member 50 will strike any obstruction before the remainder of the leading edge 41 comes into contact therewith.

If preferred, the safety member 50 may extend past the distal ends 43 of the blades 40 and thereby extend a short distance along the trailing edges 44.

FIGS. 6 to 9 illustrate a second embodiment of the propeller 110, where the three blades 140 (around the hub 120) have a substantially linear trailing edge 144.

The safety member 150 extends along the leading edge 143 of each blade 140 in the manner hereinbefore described with reference to the first embodiment of FIGS. 1 to 4.

Figure 7:
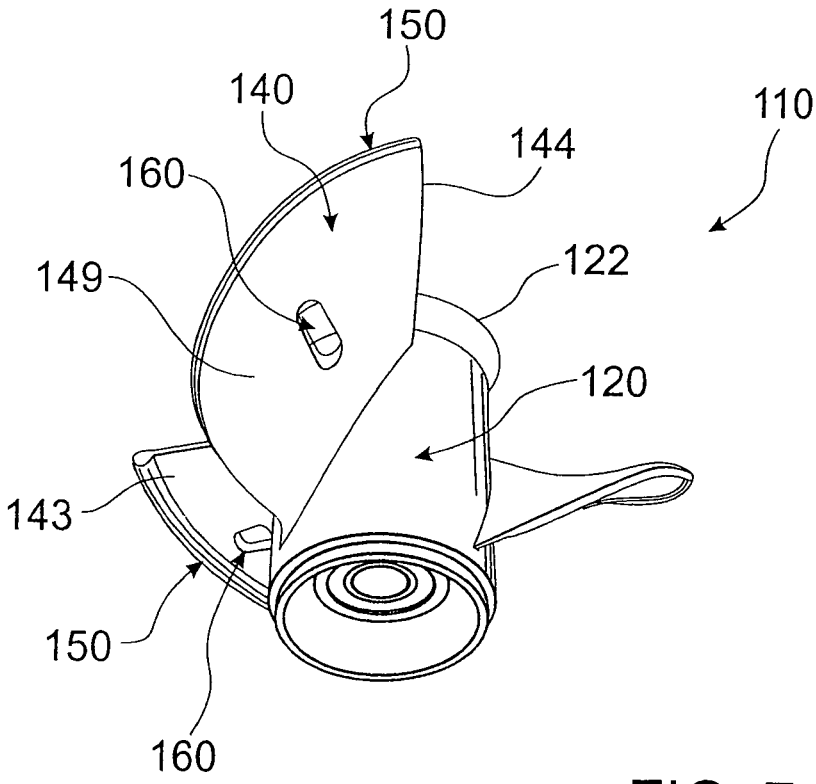
FIGS. 7 and 8 are respective perspective and side elevational views of the second embodiment.
Figure 8:
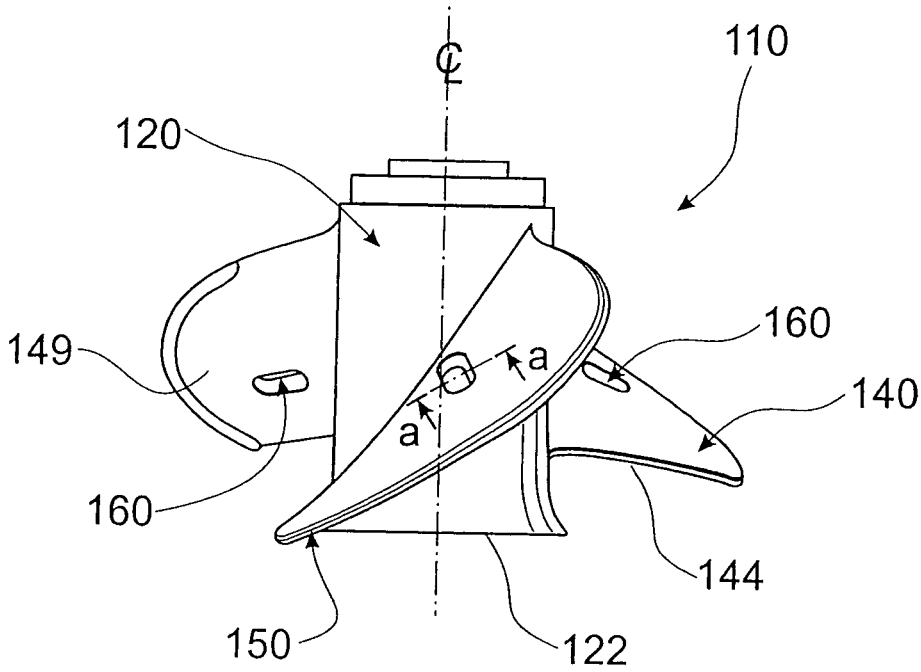

As illustrated in FIGS. 7 and 8, the safety member 150 extends from the thrust or driving face 149 of each blade 140 so that, in side view, it extends from the leading edge 143 of the blade 140 towards the trailing end 122 of the hub 120.

In this embodiment, a respective anti-cavitation slot 160 is provided in each blade 140 approximately mid-point between the leading and trailing edges 143, 144 and approximately at 50% radial distance from the hub 120.

Each anti-cavitation slot 160 has a longitudinal axis which is substantially radial to the centre line (or axis of rotation) of the hub 120.

In this embodiment, each anti-cavitation slot 160 is of modified rectangular shape, with parallel side walls 161, 162 interconnected by semi-circular end walls 163, 164.

Figure 9:
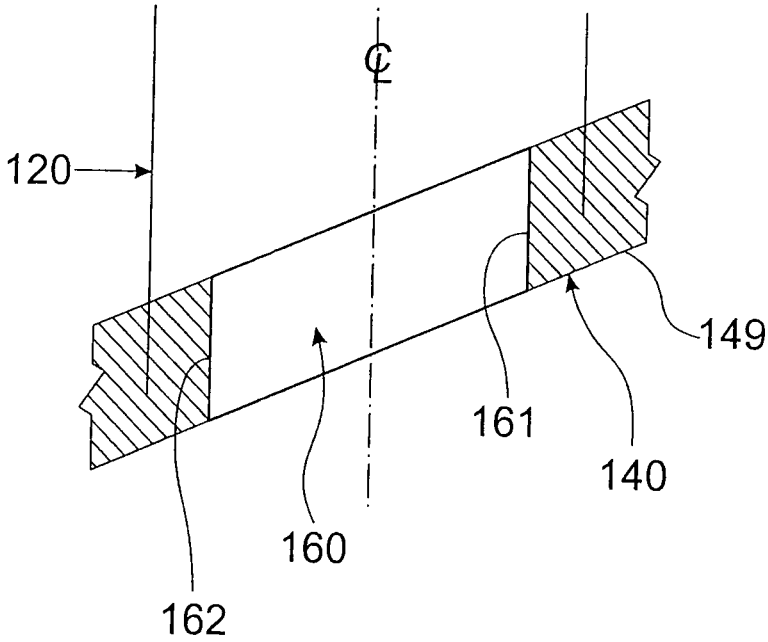
FIG. 9 is a sectional view taken on line 9-9 on FIG. 8.

As shown in FIG. 9, the side walls 161, 162 lie substantially parallel to the centre line of the hub 120 and are inclined to the opposed faces of the blade 140.

In tests conducted on a propeller 110 in accordance with this embodiment, it has been found that the propeller suffers little, if any, cavitation over a wide range of operating conditions, thereby minimising any loss of performance due to cavitation, eg., at high engine R.P.M. or on sudden acceleration. In addition, the propeller has good performance in reverse.

Figure 10:
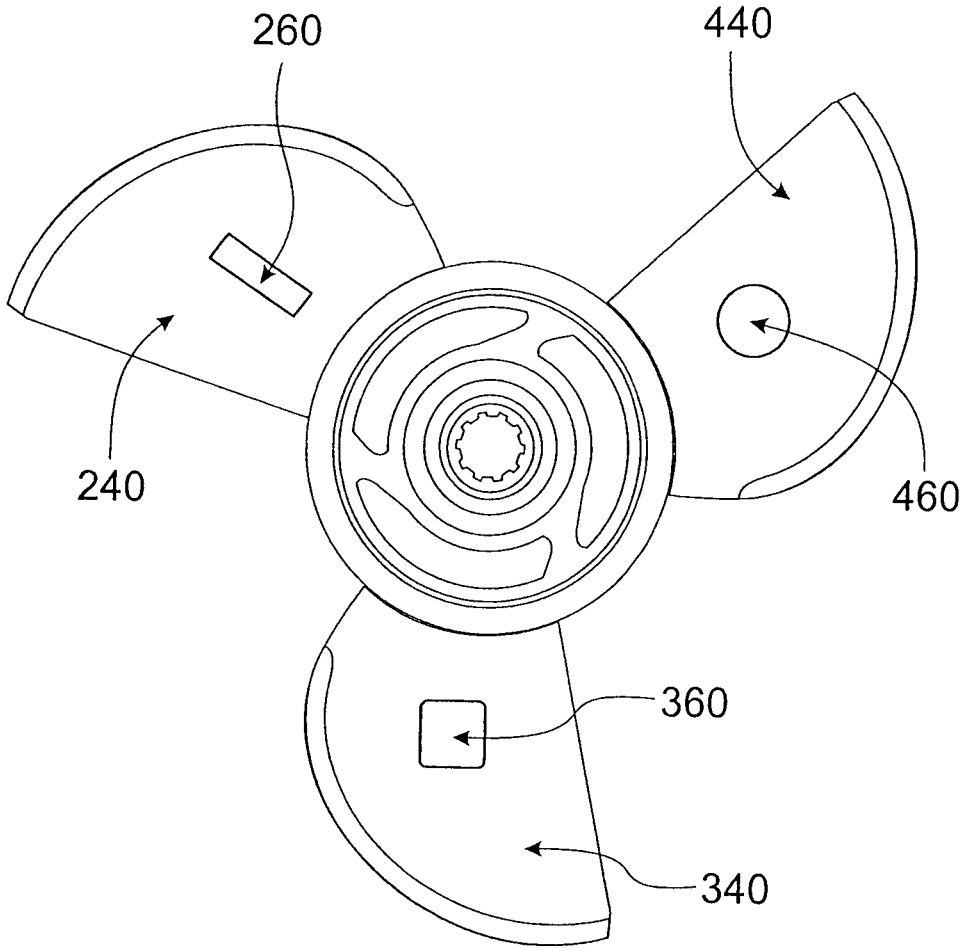
FIG. 10 is a front elevational view showing three (3) alternative shapes for the anti-cavitation slots of the second embodiment.

FIG. 10 illustrates alternative shapes for the anti-cavitation slots, including rectangular (260), square (360), and circular (460).

In another alternative, not illustrated, the cavitation slots may be "hook-shaped" and may follow the shape of the blades.

The size, shape and location of the anti-cavitation slots 160, 260, 360, 460 on the blades 140, 240, 340, 440 can be varied to suit the particular intended location.

In addition, the side walls of the anti-cavitation slots may be inclined forwardly or rearwardly, or be perpendicular to, the opposed faces of the blades.

The propeller 110 has the double advantages of the safety member 150 with the anti-cavitation slots 160 to provide a propeller which is safe in operation and with no loss of, or even improved, performance, compared to existing propellers.

Various changes and modifications may be made to the embodiments described and illustrated without departing from the present invention defined in the appended claims.

The invention claimed is:

1. A safety propeller, preferably for watercraft, of the type having a hub and a plurality of blades, where each blade has a leading edge extending from a proximal end of the blade adjacent the hub to a distal end spaced from the hub; and a respective safety member that extends over more than 50% of the length of the leading edge of each blade, each safety member being of greater height than the leading edge so that the safety member will strike any obstruction before the balance of the leading edge not provided with the safety member, and at least a portion of the safety member extending from a thrust or driving face of the blade in the forward direction of rotation of the propeller.

2. A propeller as claimed in claim 1, wherein:

for a propeller which rotates in a clockwise direction (when viewed from a trailing end of the hub), the safety member on each thrust or driving face of the blade appears to be directed towards the trailing end of the propeller.

3. A propeller as claimed in claim 1, wherein:

the safety member is of a constant height over the leading edge, or of relatively increasing height towards the distal end of the blade.

4. A propeller as claimed in claim 1, wherein:

the safety member is located with a central axis substantially parallel to, or aligned with, the leading edge, or with the central axis increasingly leading the leading edge of the blade in the direction from the proximal end to the distal end of the blade.

5. A propeller as claimed in claim 4, wherein: the safety member is smoothly contoured into the adjacent portion of the blade.

6. A propeller as claimed in claim 1, wherein: the safety member is mounted on, or formed integrally with, the blade.

7. A propeller as claimed in claim 1, wherein: at least one anti-cavitation slot is provided in each blade.

8. A propeller as claimed in claim 7, wherein: each cavitation slot is circular, square, rectangular or modified rectangular shape in plan view.

9. A propeller as claimed in claim 8, wherein: the or each side wall of the anti-cavitation slot extends through blade substantially parallel to the rotational axis of the propeller.

10. A propeller, preferably for watercraft, of the type having a hub and a plurality of blades, where each blade has a respective leading edge and a trailing edge extending from respective proximal ends of the blade adjacent the hub to a distal end spaced from the hub; wherein: one anti-cavitation slot that extends through each blade, and is located at the mid-point between (i) the respective leading edge and trailing edge of the blade and (ii) at 50% the radial distance from the hub and the distal end of the blade.

11. A propeller as claimed in claim 10, wherein:

the anti-cavitation slot is of circular, square, rectangular, modified-rectangular or other shape in plan view.

12. A propeller as claimed in claim 11, wherein:

the internal edges of the blade that together define the anti-cavitation slot lie substantially parallel to the rotational axis of the hub.

13. A propeller as claimed in claim 11, wherein: the internal edges of the blade together define at least one of a square and rectangular anti-cavitation slot such that opposed side walls of the anti-cavitation slot extend substantially parallel to a central axis of the slot extending substantially radially from the hub.

14. A propeller, preferably for watercraft, of the type having a hub and a plurality of blades, where each blade has a leading edge extending from a proximal end of the blade adjacent the hub to a distal end spaced from the hub;

a respective safety member that extends over more than 50% of the length of the leading edge of each blade, each safety member being of greater height than the leading edge, and at least a portion of the safety member extending from a thrust or driving face of the blade in the forward direction of rotation of the propeller; and one anti-cavitation slot that extends through each blade, and is located at the mid-point between (i) the respective leading edge and trailing edge of the blade and (ii) at 50% the radial distance from the hub to the distal end of the blade.

15. A safety propeller, preferably for watercraft, of the type having a hub and a plurality of blades, where each blade has a leading edge extending from a proximal end of the blade adjacent the hub to a distal end spaced from the hub; and a respective safety member that extends over more than 50% of the length of the leading edge of each blade and is of a greater thickness so that the safety member will strike any obstruction before the balance of the leading edge not provided with the safety member, with at least a portion of the safety member extending from a thrust or driving face of the blade in the forward direction of rotation of the propeller.

16. A propeller, preferably for watercraft, of the type having a hub and a plurality of blades, where each blade has a leading edge extending from a proximal end of the blade adjacent the hub to a distal end spaced from the hub;

a respective safety member that extends over more than 50% of the length of the leading edge of each blade, each safety member being of greater thickness than the leading edge, and at least a portion of the safety member extending from a thrust or driving face of the blade in the forward direction of rotation of the propeller; and one anti-cavitation slot defined through each blade, and located at the mid-point between: (i) the respective leading edge and trailing edge of the blade, and (ii) at 50% of the radial distance from the hub to the distal end of the blade.

* * * * *